US005504953A

United States Patent [19]

Singer-Leyton et al.

[11] Patent Number: 5,504,953

[45] Date of Patent: Apr. 9, 1996

[54] CUSHION SUPPORT FOR A PERSON DURING MASSAGE

[76] Inventors: Judy H. Singer-Leyton, 13037 Schoenborn St., Sun Valley, Calif. 91352; David Leyton, 17112 Cantlay St., Van Nuys, Calif. 91406

[21] Appl. No.: 308,139

[22] Filed: Nov. 10, 1994

[51] Int. Cl.[6] ..... A47C 20/00

[52] U.S. Cl. ..... 5/631; 5/900.5; 5/930; 5/632

[58] Field of Search ..... 5/630, 631, 632, 5/652, 657, 900.5, 930, 464

[56] References Cited

U.S. PATENT DOCUMENTS

| | | | |
|---|---|---|---|
| 3,118,152 | 1/1964 | Talley | 5/631 |
| 3,333,286 | 8/1967 | Biolik | 5/632 |
| 3,742,528 | 7/1973 | Munch | 5/900.5 |
| 4,021,872 | 5/1977 | Powell | 5/930 |
| 4,398,707 | 8/1983 | Cloward | 5/632 |
| 4,944,059 | 7/1990 | Wall | 5/631 |
| 5,014,375 | 5/1991 | Coonrad | 5/465 |

*Primary Examiner*—Flemming Saether
*Attorney, Agent, or Firm*—Roger A. Marrs

[57] ABSTRACT

A cushion is disclosed herein for supporting a pregnant woman in a face-down position for resting and preparatory to and during a massaging procedure. The cushion is composed of a soft, foam-like material having a central recess or cavity defined in a surrounding continuous ridge to provide an integral unitary construction. The ridge includes sidewalls joined at a front end by a neck and chin transverse end wall and joined as a rear end by a leg and knee support. Sloping wall sections join the sidewalls with the leg and knee support whereby a flat planar surface of the leg and knee support resides below the top surface of the sidewalls. Internal sloping walls connect the front and rear ends with the bottom of the recess or cavity. A cushioned insert is carried within the recess that is reversible and having opposite textured or contoured sides. A cover, a handle and a carrying strap complete the construction.

1 Claim, 2 Drawing Sheets

CUSHION SUPPORT FOR A PERSON DURING MASSAGE

BACKGROUND OF THE INVENTION

1. Field of the Invention

The present invention relates to the field of massaging devices and accessories, and more particularly to a novel cushion or pillow having a central recess for accommodating a pregnant woman in a face-down, prone position so that massaging procedures can be administered with comfort and convenience to the woman and for rest and relief of the discomforts from pregnancy.

2. Brief Description of the Prior Art

In the past, it has been the conventional practice to administer massaging procedures by having the recipient or patient lie on their side or on a flat table in a face-down, prone position. Although such an accommodation may apply to both men and women under normal circumstances, difficulties and problems have been encountered when massaging procedures and techniques are being administered to pregnant women. In such a condition, the contour of the woman is substantially extended in the abdominal area so that reclining in a face-down, prone position on a flat table is not only uncomfortable but, in most instances, impossible. Therefore, other body positions are required and the masseuse is under obligation to extend the time of performing the massage as well as being unable to perform certain techniques which otherwise would be a normal procedure.

In some instances, attempts have been made to provide comfort accommodation to a pregnant woman by utilizing pillows which are placed under the head and under the legs so that the extended abdominal area can be accommodated. Problems have been encountered when using this procedure since the full extension of the abdominal region cannot be accommodated and the settling of the pillows soon places the abdominal area against the flat hard surface of the table.

Therefore, a long-standing need has existed to provide a novel cushion for accommodating a reclining pregnant woman in a face-down, prone position so that a masseuse may apply standard massaging techniques with ultimate comfort for the woman and also allow rest and relief from the discomforts associated with pregnancy. Such-a cushion should be of integral construction, light in weight and should be portable so that it may be readily carried from place to place by a masseuse. Women have needed relief from backaches, poor circulation, fatigue, shoulder tension, numbness and swelling that are often associated with pregnancy.

SUMMARY OF THE INVENTION

Accordingly, the above problems and difficulties are avoided by the present invention which provides a novel cushion for accommodating a pregnant woman in a face-down, prone position wherein a single unitary construction is provided having an elongated member composed of soft, pliable foam-like material having a central opening or recess defined by a surrounding ridge. The ridge is provided with a neck and chin sidewall at the front end of the member while the rear end of the member is defined by a leg and knee wall which includes a flat planar surface. The neck and chin wall and the leg and knee wall are connected together by sidewalls which include sloping portions downwardly leading to the leg and knee wall. The walls are proportioned so as to support various portions of the body, such as arms, legs and head. In one form of the invention, an insert is carried within the cavity between the walls having opposite surfaces provided with different contoured patterns or configurations so that a selected pattern may be exposed in the cavity for supporting either the pregnant woman or which can be used for supporting an infant after birth. A carrying strap and handle are provided on an enclosing cover so that the cushion is portable in nature and may be carried from place to place.

Therefore, it is among the primary objects of the present invention to provide a novel cushion having adaptations for comfortably and conveniently supporting the weight and configuration of a pregnant woman in a face-down, prone position preparatory and during a massaging procedure.

Another object of the present invention is to provide a novel cushion for pregnant women whereby convenient support is provided for use during the performance of medical procedures.

Still another object of the present invention is to provide a novel cushion or pillow having a central cavity defined by sidewalls for supporting the abdominal section of a pregnant woman as the woman lies prone in a face-down position so that medical procedures or massaging procedures can be performed in comfort.

Still a further object of the present invention is to provide a novel cushion having a central opening defined by sidewalls which can readily support either a pregnant woman in a face-down, reclining or prone position or will support an infant upon a specially contoured insert at the selection of the user.

Yet another object of the present invention is to provide a novel support cushion which includes a cavity that can carry an insert having opposite sides with specially contoured surfaces that can be exposed within the cavity at the selection of the user.

Another object of the present invention is to provide a novel cushion having a central opening defined by sidewalls for supporting the abdominal section of a pregnant woman as the woman lies prone in a face-down position to obtain rest and relief from the discomforts of pregnancy.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
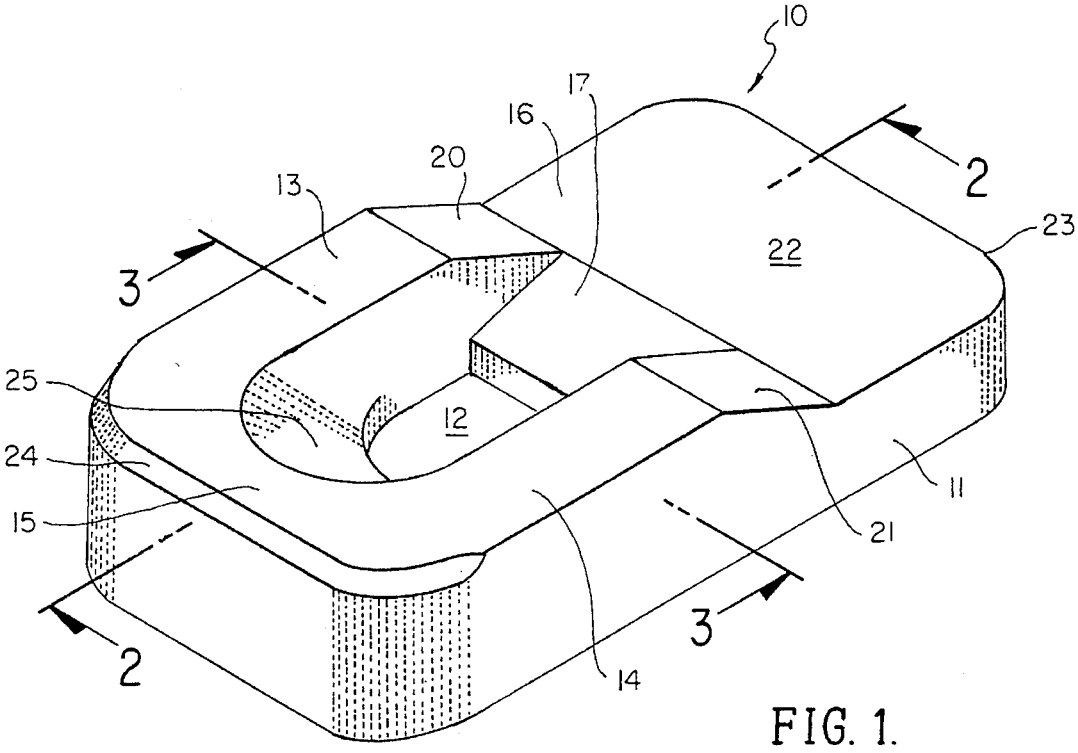
FIG. 1 is a front perspective view showing the novel cushion of the present invention.

Referring to FIG. 1, the novel cushion of the present invention is illustrated in the general direction of arrow 10, which includes an elongated cushioned member 11 that may be composed of a soft, pliable cushion or pillow material, such as open or closed cell foam-like composition. The cushion is provided with a central recess or cavity broadly indicated by numeral 12, which is defined between the opposing walls of a continuous wall comprising a pair of spaced-apart sidewalls 13 and 14 which terminate at the front end of the member 11 with a neck and chin support wall 15 and at the rear of the member 11 with a support 16 of reduced height which may be referred to as a leg and knee support. This latter wall is joined with the bottom of the recess 12 by means of a downwardly sloping ramp 17 and it can be seen that the ends of sidewalls 13 and 14 are joined to the leg and knee support 16 by means of downwardly sloping wall portions or sections 20 and 21 respectively. Also, it can be seen that the leg and knee support 16 includes a broad, flat planar surface 22 having a rear edge 23 that terminates the end of the member 11.

The front end of member 11 includes a tapered or chamfered portion 24 which serves as a chin rest. The chin and neck wall 15 join with the bottom of the recess or cavity 12 by means of a downwardly sloping front ramp 25.

Figure 2:
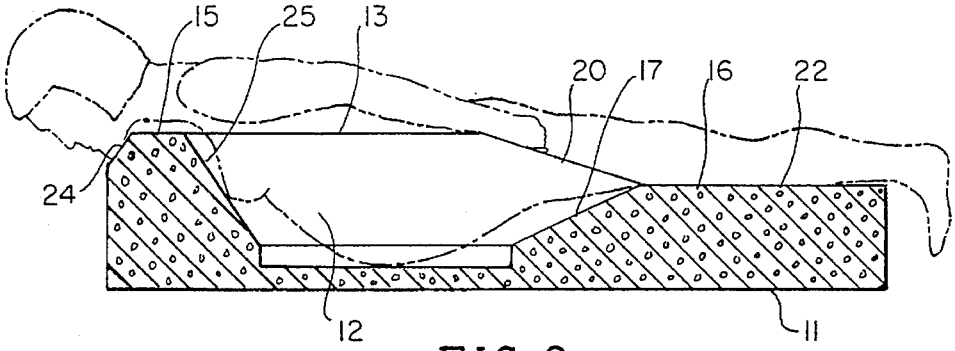
FIG. 2 is a longitudinal sectional view of the cushion shown in FIG. 1 as taken in the direction of arrows 2—2 thereof.

Referring now in detail to FIG. 2, it can be seen that a pregnant person, as illustrated in broken lines, is lying in a face-down, prone position on the massage cushion 11 preparatory for receiving a massaging treatment. The torso of the person mainly is accommodated within the recess 12 and the extended abdomen may easily connect with and be supported on the floor of the cavity, as illustrated. The person's legs and knees are supported respectively on the ramp 17 and the flat planar surface 22 of the leg and knee wall 16. With respect to the front end of member 11, it can be seen that the user's chin rests against the tapered portion 24 with the neck lying against the upper surface of the wall 15. The person's arms may readily be supported on the sidewalls 13 and 14 and can rest in a comfortable position on the downwardly sloping portions 20 and 21.

Figure 3:
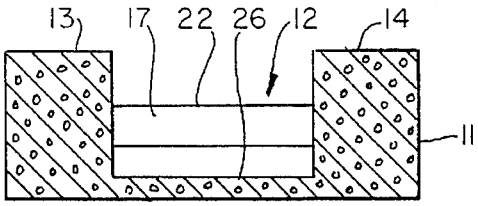
FIG. 3 is a transverse cross-sectional view of the cushion taken in the direction of arrows 3—3 of FIG. 1.

In FIG. 3, it can be seen that the ramp 17 leads to the bottom of cavity 12 wherein the bottom is indicated by numeral 26. The inner sidewall surfaces of sidewalls 13 and 14 may be contoured, if desired, or as illustrated, may be straight. Also, the edges and corners of the member 11 are rounded or non-sharp.

Figure 4:
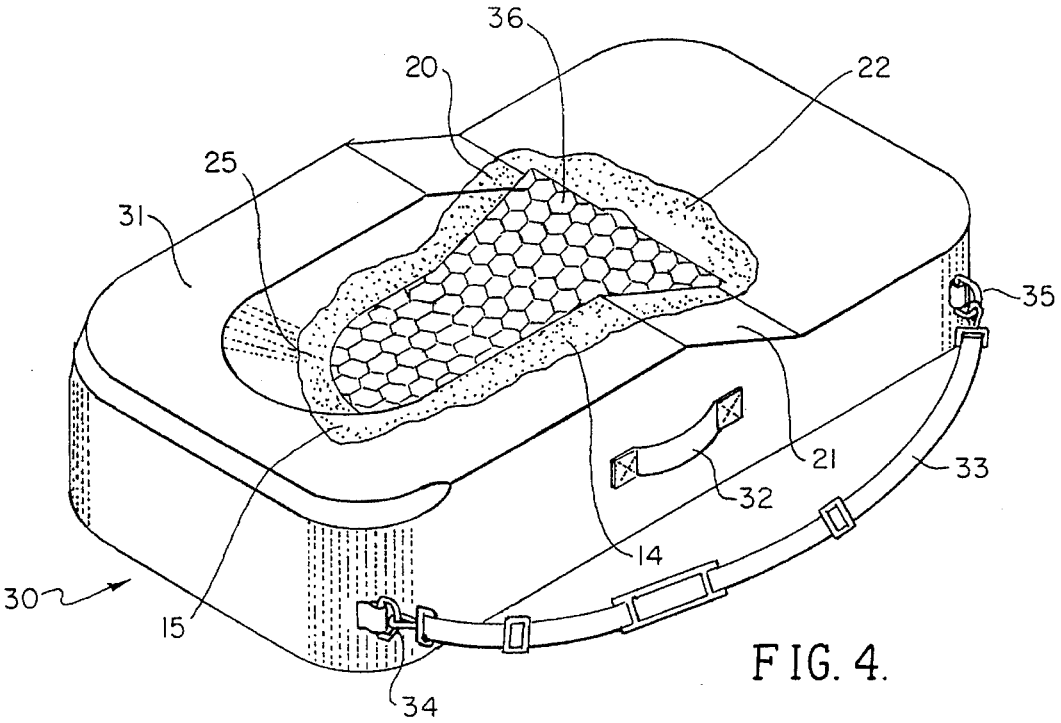
FIG. 4 is a front perspective view of another embodiment of the present invention.

Referring now in detail to FIG. 4, another embodiment of the present invention is illustrated in the general direction of arrow 30 which includes member 11, as illustrated in FIG. 1, with the further addition of a cover 31 that is formfitted about the sidewalls and all other portions of member 11. The cover 31 may readily support a handle 32 and/or a shoulder strap, identified by numeral 33. Preferably, the shoulder strap is detachably connected to D-rings 34 and 35 carried on the cover 31 at the front and rear ends of the cushion.

FIG. 4 also illustrates that the central cavity is exposed by breaking away a portion of cover 31 to expose an insert pad 36 disposed in the cavity 12.

Figure 5:
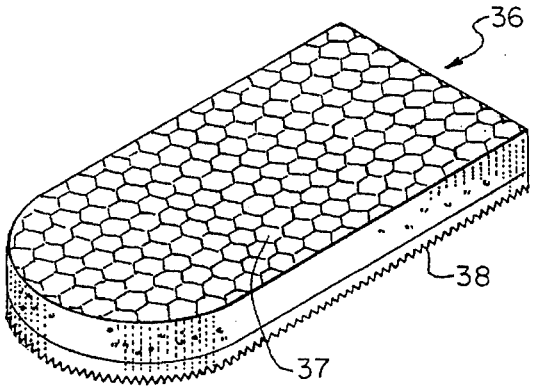
FIG. 5 is a perspective view of an insert pad that may be received within the cavity of the cushion, as shown in FIG. 4.
Figure 6:
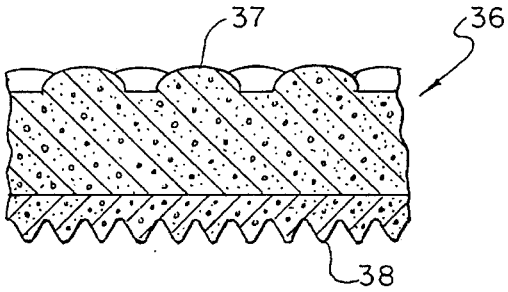
FIG. 6 is a fragmentary view, in section, of the insert illustrated greatly enlarged in order to illustrate the opposite contoured surfaces of the insert pad.

The insert pad 36 is shown more clearly in FIGS. 5 and 6 wherein the pad includes opposite surfaces provided with different contours or convolutions. For example, FIG. 5 shows a plurality of spaced-apart nubs, such as identified by numeral 37. When the pad is inserted into the cushion cavity, the comfort to the user is increased by the cushioning effect of the plurality of hubs which are placed in a particular pattern. The opposite side of the pad 36 is provided with a plurality of spaced-apart ridges, such as ridge 38, and at the desire and selection of the user, the ridged surface of the pad may be exposed when the pad is placed into the cavity 12. Again, whether the nubs 37 or the ridges 38 are exposed is at the selection of the user and by employing the insert 36, a pregnant woman can be accommodated on the cushion or the cushion can be used after birth for supporting the infant, similar to a cradle or the like.

In view of the foregoing, it can be seen that the massage cushion of the present invention is useful for several purposes and that a pregnant woman is comforted by using the device while lying in a face-down and prone position. The selection of surfaces on the pad 36 is helpful to the massage procedure in that greater comfort is given to the user of the cushion. By providing a cover 31, the cushion may be kept clean and also may be transported from place to place in a portable fashion. Therefore, since it has always been difficult to administer a thorough massage to a pregnant woman without having the woman lie on her stomach, the present invention provides the comfort for the woman and eliminates the difficulty. Women oftentimes experience extreme pain to the lower back and legs where it is not possible to lie on their stomach to relieve such discomfort. The cushion or pillow of the present invention is designed for this specific purpose. The cushion or pillow not only allows a pregnant woman to lie on her stomach, but the pillow or cushion will provide a safe and comfortable way for a pregnant woman to receive care from a chiropractor or masseuse. The cushion or pillow can also be used to relieve pain and discomfort in the lower back and legs. The large covered foam cushion is provided with the recess or cavity to allow comfortable support for the woman's abdomen. The surrounding foam ridge supports the head, shoulders, arms and legs.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A massage cushion for supporting a person during a massaging procedure comprising:

an elongated cushion composed of a material;

said cushion provided with a central cavity;

a front wall of said cushion having a height approximately twice the height of a rear support;

a pair of parallel, spaced-apart sidewalls integrally connecting said front wall with said rear support;

said rear support having a flat planar surface for supporting the legs and knees of a user;

said front wall having a chamfered portion supporting the neck and chin of the user;

said cushion central cavity defined between said pair of sidewalls and said front wall and rear support adapted to accommodate the abdomen and breasts of the user;

said sidewalls are in spaced-apart relationship and terminate with said rear support via a pair of downward sloping portions for supporting the arms of the user;

a downwardly sloping rear ramp disposed between said pair of sloping portions and between said sidewalls leading into said central cavity from said rear support;

a downwardly sloping front surface leading into said cavity from said front wall and between said sidewalls;

said downwardly sloping front surface is disposed on the opposite side of said front wall from its side carrying said chamfered portion;

a pad removably disposed in said central cavity between said sidewalls;

said pad includes opposite surfaces;

different patterns of projections carried on said opposite surfaces;

said projections on one pad surface is a plurality of spaced-apart parallel ridges; and said projections on the other pad surface is a plurality of spaced-apart domes;

said pad has two ends of which one end is rounded and the other end is straight so that said pad is conformal with the shape of said central cavity;

a pliable cover disposed about said elongated cushion and conformal in shape therewith so as to be an integral portion thereof; and a side handle secured to said cover.

* * * * *